US007353714B2

(12) United States Patent
England et al.

(10) Patent No.: US 7,353,714 B2
(45) Date of Patent: Apr. 8, 2008

(54) METHOD AND APPARATUS FOR AUTOMATIC LOAD TESTING USING BI-DIRECTIONAL TESTING

(75) Inventors: Melvin G. England, Sunbury Upon Thames (GB); John A. Hayes, Gainesville, FL (US)

(73) Assignee: Loadtest, Inc., Gainesville, FL (US)

( * ) Notice: Subject to any disclaimer, the term of this patent is extended or adjusted under 35 U.S.C. 154(b) by 84 days.

(21) Appl. No.: 11/192,765

(22) Filed: Jul. 29, 2005

(65) Prior Publication Data

US 2006/0021446 A1 Feb. 2, 2006

Related U.S. Application Data

(60) Provisional application No. 60/592,484, filed on Jul. 30, 2004.

(51) Int. Cl.

| | |
|---|---|
| ***G01B 5/00*** | (2006.01) |
| ***G01B 7/16*** | (2006.01) |
| ***G01L 1/00*** | (2006.01) |
| ***G01N 3/00*** | (2006.01) |
| ***G01N 33/24*** | (2006.01) |

(52) U.S. Cl. ..... 73/784

(58) Field of Classification Search ..... 73/806, 73/803, 784, 818, 786

See application file for complete search history.

(56) References Cited

U.S. PATENT DOCUMENTS

| | | | | |
|---|---|---|---|---|
| 4,614,110 A | | 9/1986 | Osterberg | |
| 4,845,996 A | * | 7/1989 | Bermingham | 73/807 |
| 5,172,587 A | * | 12/1992 | Long | 73/84 |
| 5,576,494 A | | 11/1996 | Osterberg | |
| 5,581,013 A | * | 12/1996 | Frederick | 73/11.03 |
| 5,608,169 A | * | 3/1997 | Fujioka et al. | 73/803 |

(Continued)

FOREIGN PATENT DOCUMENTS

| | | |
|---|---|---|
| DE | 34 24 776 A1 | 1/1986 |

(Continued)

OTHER PUBLICATIONS

Da Silva, Pedro Elisio C.A.F., Hidrodynamic Expansive Cell—A New Way to Perform Loading Tests, 1983, pp. 1-44, Brazil.

(Continued)

*Primary Examiner*—Michael Cygan
*Assistant Examiner*—Octavia Davis
(74) *Attorney, Agent, or Firm*—Saliwanchik, Lloyd & Saliwanchik

(57) ABSTRACT

The subject invention pertains to a method and apparatus for testing the static load-bearing capacity of a pile. In an embodiment, one or more load devices for applying a test load can be disposed within a pile such that a pile element can be above the load device, and a pile element can be below the load device. Upon applying a test load, the pile element above the load device and the pile element below the load device tend to separate. The test loads applied to the pile can be controlled in response to the magnitude of the test load, the combined settlement rate of the pile elements, the displacement of the pile elements, and the compression of the pile elements. A test regime can continue until a programmed regime is completed or a fail-safe trigger event occurs.

55 Claims, 5 Drawing Sheets

U.S. PATENT DOCUMENTS 6,311,567 B1 * 11/2001 England ..... 73/806

FOREIGN PATENT DOCUMENTS

| | | |
|---|---|---|
| EP | 0 849 405 A1 | 6/1998 |
| GB | 2 323 174 A | 9/1998 |
| IL | 58035 | 11/1981 |

OTHER PUBLICATIONS

England, M. et al., Review of Foundation Testing Methods and Procedures, Jul. 1994, pp. 135-142, vol. 107,Proc. Inst. of Civ. Engineers, Geotechnical Engineering, London, GB.

* cited by examiner

METHOD AND APPARATUS FOR AUTOMATIC LOAD TESTING USING BI-DIRECTIONAL TESTING

CROSS-REFERENCE TO RELATED APPLICATION

This application claims priority from provisional application U.S. Ser. No. 60/592,484; filed Jul. 30, 2004, which is hereby incorporated by reference herein in its entirety, including any figures or drawings.

FIELD OF THE INVENTION

The present invention relates to a method and apparatus for testing the static load-bearing capacity of engineering piles.

BACKGROUND OF INVENTION

Piles, usually made out of concrete, are generally used to form the foundations of buildings or other large structures. Before using the piles as a foundation for further building work, it is important to test the static load-bearing capacity of each pile. This is generally done by applying a test load to the top of a pile by way of a hydraulic jack braced against a reaction system having a cross-beam that is anchored in place at its ends. The test load is generally measured by monitoring the hydraulic pressure supplied to the jack, and the associated displacement of the pile is measured by using a displacement sensor. Frequently, the displacement of the pile is measured for a number of increasing test loads, each applied for a predetermined time. Because the applied test loads tend to be high, there is a significant danger to operating personnel should the cross-beam or its anchorages fail, particularly if the operating personnel are required to read test values from one or more gauges located on equipment located close to the top of the pile.

Furthermore, because the applied test load has to be maintained and adjusted by operating the jack manually, it is necessary for operating personnel to be in attendance at all times. It is not safe for a single operator to work alone, particularly overnight (the typical time taken to perform a comprehensive static load test can often be as much as 18 hours). Accordingly, the typical method of static load testing is expensive, as well as being slow.

Another disadvantage of the known static load-testing equipment is that the quality of the data obtained is not always consistently good. Typical data required from a static load test are the record of displacement of the pile head and the load applied. Although manual reading and recording of the dial gauges employed in a static load test should not present an insurmountable difficulty in terms of accuracy and regularity, it is the application of the load that generally is the source of poor quality data. This is principally due to the need to attend continuously to a manual hydraulic pump in order to maintain the load with any degree of constancy. A further source of error arises through the use of a pressure gauge to derive the applied test load by way of calibration charts. The accuracy with which the load can be maintained is governed by the resolution with which the gauge can be read. Assuming the operator performing the load control is entirely dedicated and doing his utmost to maintain the load, he may at best be able to read a pressure or load column gauge to 1%. This implies that the load variation is not likely to be better than around +/−2%. This in turn means that the pile head displacement recording of a pile whose elastic shortening alone is about 5 mm, will fluctuate by +/−0.1 mm according to this load variation.

British patent application GB 2323174A teaches a method and apparatus for testing the static load-bearing capacity of a pile. However, this teaching relates to the application of load at the top of the pile by way of a jack braced against a reaction member suitably anchored into the ground, such that the full test load needs to be applied to the foundation under test.

U.S. Pat. No. 4,614,110 and U.S. Pat. No. 5,576,494 teach a method of loading from the bottom of a pile where a load device is positioned between the bottom of a pile and the bottom of the hole in which the pile is located.

BRIEF SUMMARY OF THE INVENTION

The subject invention pertains to a method and apparatus for automatic load testing of a foundation element using bi-directional testing. The subject invention can be applicable to any foundation element in the ground to support structural loads, such as a diaphragm wall, berrettes, or a pile as described in the embodiments of the subject invention. In an embodiment of the subject invention, a means to apply a test load, or load device, is located between two sections of a pile such that the pile is split into a first pile element above the load device and a second pile element below the load device. The pile can be, for example, a poured or driven pile. A means for controlling the magnitude of a test load can communicate to the load device to apply a test load to the pile. In a specific embodiment, the load device can incorporate two plates that can tend to separate when the load device is activated. The application of a load by the load device can cause the upper plate to push upward against the first pile element and the lower plate to push downward against the second pile element. In a further embodiment, a top loading device can be located at the top of the first pile element, where the top loading device can push down on the top of the first pile element.

The means for controlling the magnitude of a test load can, during a test, also monitor and respond to one or more of the following: the magnitude of the test load, the separation between the two plates of the load device, the compression of the first pile element, the upward displacement of the top of the first pile element, the compression of the second pile element, and the downward displacement of the second pile element.

A specific embodiment of the subject invention involves the insertion of a jack during construction of the pile, at a level within the pile such that the pile may be split in a plane normal to the axis of the pile into at least two pile elements. The load applied to the first pile element by such a jack is derived by reaction from the second pile element. In this manner, the pile can be considered to be split into two and each pile element becomes the subject of a separate test by deriving its reaction load against the other.

According to a first aspect of a specific embodiment of the present invention, there is provided a method of testing the static load-bearing capacity of a pile, wherein:

i) a test load is applied from within the pile by way of at least one jack cast within the pile section;

ii) the magnitude of the test load is determined by measuring means and communicated to a computer;

iii) the resulting displacement of each section of the pile is measured by at least one displacement sensor and communicated to the computer; characterized in that:

iv) the computer issues control signals to the jack in response to the measured magnitude of the test load so as to keep the test load substantially constant;

v) the computer determines when a definite settlement for each section of the pile has been attained or when a defined settlement rate has been exceeded by one of the sections and then issues control signals to the jack so as to apply a new test load of different magnitude to each element of the pile in accordance with a predetermined regime of test loads; and vi) steps ii) to v) are repeated until the test regime is completed.

According to a second aspect of a specific embodiment of the present invention, there is provided an apparatus for testing the static load-bearing capacity of a pile, the apparatus comprising:

i) a computer;

ii) a jack, which in use is cast within the pile and applies a test load to which splits the pile and subsequently applies force to each element of the split pile;

iii) means for measuring the magnitude of the test load and communicating this to the computer;

iv) at least one displacement sensor for measuring the resulting displacement of each section of the pile and communicating this to the computer; characterized in that:

v) the computer is adapted to issue control signals to the jack in response to the measured magnitude of the test load so as to keep the test load substantially constant;

vi) the computer is adapted to determine when a definite settlement for each section of the pile has been attained or when a defined settlement rate has been exceeded by one of the sections and then to issue control signals to the jack so as to apply a new test load of different magnitude to each element of the pile in accordance with a predetermined regime of test loads; and vii) the computer is adapted to repeat steps v) and vi) until the test regime is completed.

By providing computer control of the load testing procedure, together with automatic data logging, the present invention can provide a much more detailed analysis of the structural integrity of each section of the pile to be obtained. This analysis can be presented in real-time, advantageously in tabulated and/or graphic form, and reduces the risk of errors being introduced through manual processing of the data.

Furthermore, because the computer receives data regarding the actual test load applied to each section of the pile, operating signals can be sent to the jack in order to, for example, maintain a given test load even when one section of the pile is being displaced or both sections of the pile are being displaced simultaneously. This means that a given test load can be applied for a long period of time without the need for operating personnel to be present in order to manually adjust the applied load. In an embodiment, a testing specification can require each load to be applied for a minimum duration and for a further time to allow the settlement rate of one or more pile elements to be lower than a prescribed value. Upon the settlement rate of the one or more pile elements being below the prescribed value, the testing specification can then require a higher load be applied for a minimum duration and the settlement rate for one or more pile elements to be below a prescribed value, which can be the same or different than the previous prescribed value. A data logger or computer can monitor the settlement rate measurements and compare to preset levels to assess if the next load step can be applied.

The computer can be arranged so as to control the jack to apply a number of different test loads to the pile, each for a predetermined minimum period of time or until a definite settlement rate has been achieved with either section of the pile. In order to do this, the required load steps and intervals may be defined, together with specific settlement rates. The settlement rate can be measured directly or indirectly on one or more of the elements and/or a combined settlement rate of the one or more elements can be determined. The computer can then control the test load and make the required load changes as required. Load changes may be performed by successively increasing the applied load in small increments until the next desired substantially constant load level is achieved. If the settlement rate of either section during the load change exceeds a predetermined maximum value, then the increase of the applied load may be paused until the settlement rate stabilizes. In a specific embodiment, the jack's extension can be monitored, directly or indirectly, by, for example, displacement measuring sensors. In an embodiment, the combined settlement rate of the first and second pile elements can be determined from the one set of jack extension measurements. This embodiment is advantageous because only one set of measurements need to be analyzed while the settlement rates of both elements are simultaneously being monitored.

The ram extension of the jack can be measured directly with displacement measuring sensors. In an embodiment, the displacement measuring sensors can be extensometers cast around the jack or embedded within the jack. These may be, for example, linear voltage displacement transducers (LVDT)'s or Linear Vibrating Wire displacement transducers (LVWDT)'s. In an embodiment, the ram extension of the jack can be monitored by measuring the volume of hydraulic fluid pumped to the jack by the hydraulic control system. This can be achieved by using a volumetric flow meter, determining the level of hydraulic fluid in a reservoir of known size with a float or other means, or by any other suitable method.

Alternatively, or in addition, at least one additional displacement sensor can be provided in order to detect any upward movement of the upper element of the pile. In a specific embodiment one or more extensometer rods can be positioned to measure the upward movement of an upper plate of an expansion device or the top of the jack.

In an alternate embodiment, the ram extension of the jack can be measured indirectly. The ram extension of the jack can be determined from the difference of the measurements from means to measure the upward movement of the upper plate and means to measure the downward movement of the bottom plate. Such means can include, for example, one or more extensometer rods provided to detect upward movement of the upper plate and a second extensometer rod provided to detect downward movement of the lower plate. The difference between the two measurements is the jack extension. Alternate ways to measure the ram extension of the jack, such as measuring the movement of the upper plate and the movement of the lower pile element can be employed. In an embodiment, an extensometer rod can be used to measure the downward movement of the lower pile element. This second extensometer rod can be positioned to directly measure the downward movement of the lower plate with respect to a reference point. For example, in a specific embodiment, the reference point can be the pile head or the top of the extensometer casing. When the ram extension of the jack reaches or exceeds a predetermined value, this may be an indication of a failure or a progressive failure of one element of the pile, and a signal can be generated to halt the testing process.

In an alternate embodiment the downward movement of the lower pile element can be measured indirectly. In this embodiment, the downward movement of the lower pile element can be determined from the difference of the directly measured ram extension of the jack and the directly measured upward movement of the upper pile element. The movement of the base of the lower pile element can be monitored by having a telltale extensometer extending from a reference down to the base of the lower pile element. The reference can be, for example, ground level, top of concrete level, or from the underside of one of the plates of the jack. In this embodiment, as the expansion of the jack can cause a break in the casing of the extensometer, the extensometer casing can be scored to weaken the pipe at a desired point to encourage the break at that desired point. The movement of the top and bottom of each jack and the top and bottom of the entire foundation element can also be monitored. In a specific embodiment extensometer rods or buried sensors can measure the movements of the top and bottom of each jack, the top of the top pile element, and the bottom of the bottom pile element.

In a preferred embodiment, the jack is a hydraulic jack controlled by the computer by way of a hydraulic control system. The applied test load may be calculated by monitoring the fluid pressure in the hydraulic control system driving the jack. This method, however, has the disadvantage that it is temperature sensitive (due to thermal expansion of the hydraulic fluid), and does not take into account friction between the jack and the point of contact with the pile in the event that the test load is being applied eccentrically.

Accordingly, an alternative embodiment uses one or more electronic load cells. In a further embodiment, the electronic load cells can employ balanced strain gauges around a coaxial element. These may be placed above the jack on, for example, a spherical seating arrangement so as to reduce the risk of eccentric loading. Because the load cells measure the actual load applied to the pile elements, it is possible to operate the jack or jacks at the same level by way of the hydraulic control system so as to apply a substantially constant load, even when the pile elements are undergoing displacement. This feedback mechanism allows the applied load to each element to be held constant to a degree hitherto not achieved with manually-operated systems. The time interval between successive measurements of applied load and pile element displacement can be of the order of a few seconds, for example from 1 to 5 seconds. With the hydraulic control system set to adjust the hydraulic pressure applied to the jack or jacks in direct response to these measurements and on a similar timescale, a level of control previously not attained can be achieved, thereby greatly improving the quality of the testing results.

Advantageously, the computer can be arranged to prolong the duration of application of load until the specified settlement rate has been achieved. In addition, the computer can be arranged so as to halt the testing process automatically, by for example, stopping the flow of hydraulic fluid to the jack or jacks, when certain conditions are detected. This automatic fail-safe procedure is a further advantage over the known methods of static load-testing, and can allow the present invention to be left unattended without undue risk. The fail-safe condition may be triggered, for example, in one or more of the following situations:

i) Where the magnitude of the applied test load reaches or exceeds a predetermined value. This may be, for example, the maximum rating of the jack or the load cell.

ii) Where the magnitude of the applied test load drops by at least a predetermined amount, for example 10%, at a time when a constant load is to be maintained. This may be due to abrupt failure of either reaction system or failure of the foundation under test. Depletion of consumables such as hydraulic fluid and compressed air fail-safe intrinsically, and it therefore may not be necessary to monitor their supply.

iii) Where the magnitude of the measured displacement of either element of the pile reaches or exceeds a predetermined value, for example 10% of the pile diameter. This may be due to progressive failure of the pile element, or excessive displacement of the pile element due to structural failure.

iv) Where the power supply to the computer falls to or below a predetermined level. If this happens, the test can be discontinued and priority given to the storage of data in a passive mode. In embodiments where a 12V battery is used as a power supply, the fail-safe condition may, for example, be triggered when the potential difference across the battery drops below 10V.

v) Where communication between the load measuring means and/or the displacement sensors and the computer is broken. This may happen as a result of electrical connections between the computer and the displacement sensors or the load cells or pressure cells being accidentally disconnected.

vi) In embodiments of the present invention in which two or more displacement sensors are disposed at different locations about the circumference of the pile element, where the difference between the magnitudes of the displacements measured by the two or more displacement sensors reaches or exceeds a predetermined value, for example 50% of the average value recorded. This indicates that unwanted lateral loads are being applied to the pile, which in extreme cases can lead to premature structural damage or failure. This fail-safe also helps to detect misreading from one or more of the displacement sensors.

In an embodiment, the area surrounding a pile test being undertaken in accordance with the present invention can be cordoned off with bunting, and a fine wire conductor system or trip wire may be installed so as to detect unauthorized access to the test site. Alternatively optical systems may be employed using either passive infrared detection of direct interruption of a light beam by any unauthorized access to the area. The computer can be configured so as to trigger the fail-safe condition in this event.

When the fail-safe condition is triggered, an alarm signal may be generated. This alarm signal may be transmitted to an operator or to a remote site by way of a mobile telephone or radio link, or by any other suitable method. Furthermore, data and control signals may be transmitted from and received by the computer so as to allow remote interrogation and control.

In a further embodiment of the subject invention a second load device can be located between two sections of the pile, below the first load device, such that the pile is split into a first pile element above the first load device, a second pile element between the first and second load devices, and a third pile element below the second load device. Alternatively, the second load device or an additional load device can be located at the bottom of a pile, or a third or more load device can be located between two sections of the pile creating a fourth or more pile element. In an alternate embodiment, a top loading device can additionally be located at the top of a pile such that, as a load is applied to the top of the pile, the top loading device pushes down on the first pile element. In a specific embodiment, the first and second load devices can each incorporate two plates that can tend to separate when the load devices are activated. The application of a load by the first load device can cause its upper plate to push upward against the first pile element and its lower plate to push downward against the second pile element and an application of a load by the second load device can cause its upper plate to push upward against the second pile element and its lower plate to push downward against the third pile element.

The means for controlling the magnitude of a test load can communicate to the first and second load device to apply test loads to the pile. The first and second load devices can also be separately controlled by the means for controlling the magnitude of a test load in conjunction or individually in accordance with a programmed testing sequence and/or in response to one or more of the following: the magnitude of the first and second test load, the expansion of the first load device, the compression of the first pile element, the upward displacement of the first pile element, the expansion of the second load device, the upward displacement of the second pile element, the downward displacement of the second pile element, the compression of the second pile element, the compression of the third pile element, and the downward displacement of the third pile element.

In a further application of this system, the means for controlling the magnitude of a test load may be used to control the application of load by a jack or series of jacks disposed at more than one level within the pile. Automatic control of the hydraulic pressure to each of the jacking levels can be prearranged and controlled completely automatically according to a series of preset conditions. Further, the hydraulic pressure applied to each of the jacking levels need not be applied simultaneously by using a plurality of pumping systems.

DETAILED DISCLOSURE OF THE INVENTION

The subject invention pertains to a method and apparatus for automatic load testing of a foundation element using bi-directional testing. The subject invention can be applicable to any foundation element in the ground to support structural loads, such as a diaphragm wall, berrettes, or a pile as described in the embodiments of the subject invention. The subject invention can incorporate a means to apply a test load to a pile. In a specific embodiment, the means to apply a test load can incorporate a load device. In an embodiment of the subject invention, a load device is located between two sections of a pile such that the pile is split into a first pile element above the load device and a second pile element below the load device. The pile can be, for example, bored cast in-situ concrete, driven precast concrete, or driven steel tubular piles. For the steel tubular piles, steel tubes can be driven or pushed into the ground, concrete can be poured in, and then the steel tubes can be removed, leaving a concrete pile. A means for controlling the magnitude of a test load can communicate to the load device to apply a test load to the pile. In a specific embodiment, the load device can incorporate two plates that can tend to separate when the load device is activated. The application of a load by the load device can cause the upper plate to push upward against the first pile element and the lower plate to push downward against the second pile element. The means for controlling the magnitude of a test load can also monitor at least one of the following: the magnitude of the test load; the separation, $d_1$, between the two plates of the load device; the compression, $\Delta h_1$, of the first pile element; the upward displacement, $\Delta h_{t1}$, of the top of the first pile element; the compression, $\Delta h_2$, of the second pile element; and the downward displacement, $\Delta h_{b2}$, of the bottom of the second pile element.

The means to apply a test load can also incorporate a pressurized fluid supply connected by a pressurized fluid supply line to an expansion means, where the expansion means can tend to separate an upper plate and a lower plate in response to the supply of pressurized fluid transmitted by the pressurized fluid supply line to the expansion means. The means for controlling the magnitude of a test load can monitor the magnitude of the test load by monitoring the fluid pressure. Alternatively, the means for controlling the magnitude of a test load can monitor the magnitude of the test load with electronic load cells. In a specific embodiment, the two plates are parallel. In addition, a pressurized fluid exhaust line can selectively remove the pressurized fluid from the expansion means.

Figure 4:
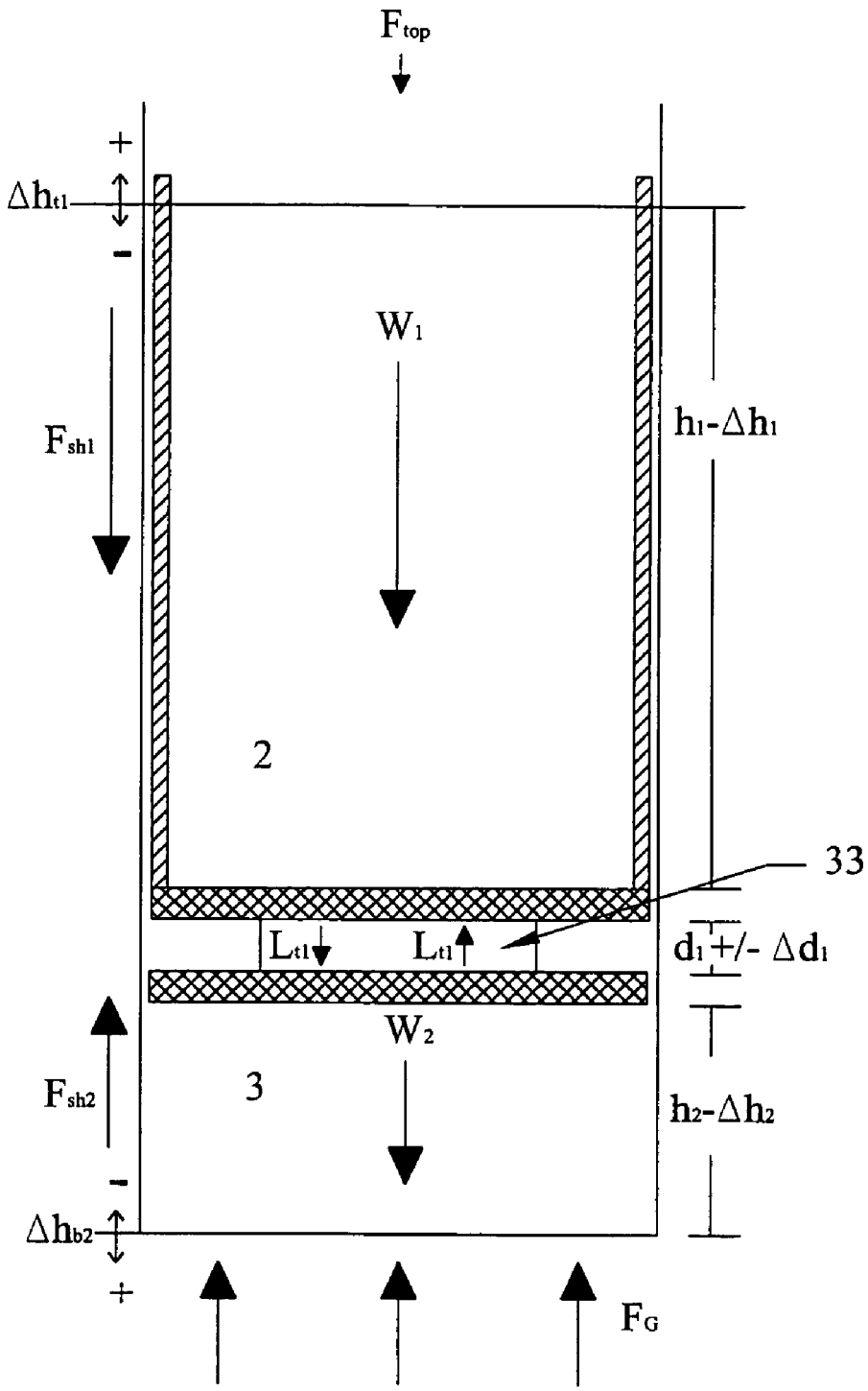
FIG. 4 shows forces on the pile elements in an embodiment of the subject invention using a single load device.

Referring to FIG. 4, as the means for controlling the magnitude of a test load applies a test load, $L_{T1}$, through the load device 33, the load device 33 can expand from an initial displacement, $d_1$, to $d_1+\Delta d_1$. The internal pressure of the load device 33 exerts a force, $L_{T1}$, upward, on the first pile element 2 and an equal force, $L_{T1}$, downward, on the second pile element 3. The upward force of the load device 33, $L_{T1}$, is resisted by the downward weight, $W_1$, of the first pile element 2 and by the skin friction, or shear force, $F_{sh1}$, exerted on the outer surface of the side of the first pile element 2 by the soil or rock surrounding the first pile element 2. Optionally, a top loading force, $F_{top}$, can be applied to the top of the first pile element 2 to additionally resist the upward force of the load device 33. The downward force of the load device 33, $L_{T1}$, on the second pile element 3, combined with the weight, $W_2$, of the second pile element 3, is resisted by the skin friction, or shear force, $F_{sh2}$, exerted by the soil or rock surrounding the second pile element 3 on the sides of the second pile element 3 and the force, $F_G$, upward on the second pile element 3 by the underlying earth support.

The relationship between the expansion of the load device 33, $\Delta d_1$, and movement of the first and second pile elements 2 and 3 is $\Delta d_1=\Delta h_{t1}+\Delta h_1+\Delta h_{b2}+\Delta h_2$, where $\Delta h_{t1}$ is the upward displacement of the first pile element 2, $\Delta h_1$ is the compression of the first pile element 2, $h_{b2}$ is the downward displacement of the second pile element 3, and $\Delta h_2$ is the compression of the second pile element 3.

In a specific mode of operation, an embodiment of the subject means for controlling the magnitude of a test load can allow the application and maintenance of a constant test load. The means for controlling the magnitude of a test load can detect the magnitude of the test load, the gradual displacement or compression of the first or second pile elements 2 and 3, as well as the separation $\Delta d_1$ of the load device, and utilize this information to maintain a constant load. In a specific embodiment, the means for controlling the magnitude of a test load can apply a constant test load by adjusting the supply of pressurized fluid to the expansion means in response to one or more of the following measurements: the magnitude of the test load; the expansion, $\Delta d_1$, between the two plates of the load device 33; the compression, $\Delta h_1$, of the first pile element 2; the upward displacement, $\Delta h_{t1}$, of the top of the first pile element 2; the compression, $\Delta h_2$, of the second pile element 3; and the downward displacement, $\Delta h_{b2}$, of the second pile element 3. In a further embodiment, the means for controlling the magnitude of a test load can hold the magnitude of the test load constant for a predetermined period of time before increasing the magnitude of the test load to a new value, and/or can modify the test load at a desired rate. In this way, a desired testing scheme can be implemented.

The means for controlling the magnitude of a test load can continue to apply the load until the means for controlling the magnitude of a test load detects test failure. In a specific embodiment, test failure can occur when $L_{T1}>(F_{sh2}+F_G-W_2)_{fail}$, which can cause the second pile element 3 to rapidly move downward, or when $L_{T1}>(F_{sh1}+F_{top}+W_1)_{fail}$, where $F_{top}$ is optional, which can cause the first pile element 2 to rapidly move upward. Additionally, the means for controlling the magnitude of a test load can stop the load test when one or more fail-safe measures are triggered. Such fail-safe measures can include, but are not limited to the following: reaching a predetermined value for the magnitude of the test load, detecting a sudden change in the magnitude of the test load, detecting a power or communications error in the means for controlling the magnitude of a test load, or detecting a breach in security at a testing location.

In a specific embodiment, the means for controlling the magnitude of a test load can monitor a means to measure separation of load device plates, $\Delta d_1$, for rapid expansion of the plate separation, indicating $L_{T1}>(F_{sh1}+F_{top}+W_1)_{fail}$, where $F_{top}$ is optional, or $L_{T1}>(F_{sh2}+F_G-W_2)_{fail}$, and terminate the test. Upon detection of rapid expansion, $\Delta d_1$, of load device 33, the means for controlling the magnitude of a test load can stop the load tests. In a further embodiment, the means for controlling the magnitude of a test load can monitor a means to measure upward displacement, $\Delta h_{t1}$, of the first pile element 2 for upward movement of the first pile element 2. In this case, if the means for controlling the magnitude of a test load detects rapid $\Delta d_1$ and rapid $\Delta h_{t1}$, indicating $L_{T1}>(F_{sh1}+F_{top}+W_1)_{fail}$, then the means for controlling the magnitude of a test load can stop the load test. Conversely, if the means for controlling the magnitude of a test load detects rapid $\Delta d_1$, but not rapid $\Delta h_{t1}$, then the means for controlling the magnitude of a test load can determine that $\Delta h_{b2}$ is rapid, indicating $L_{T1}>(F_{sh2}+F_G-W_2)_{fail}$, and can stop the load test. In addition, the means for controlling the magnitude of a test load can determine the downward displacement, $\Delta h_{b2}$, of the second pile element 3 by derivation from the upward displacement, $\Delta h_{t1}$, of the first pile element 2 and the expansion, $\Delta d_1$, of the load device 33. In a further embodiment, the means for controlling the magnitude of a test load can additionally, or alternatively, monitor a means to measure downward displacement, $\Delta h_{b2}$, of the second pile element 3 for downward movement of the second pile element 3.

In an alternate embodiment, a top load, $F_{top}$, can be applied to the top of the first pile element 2 to increase the test load that can be applied to the top pile element before the top pile element experiences rapid movement upward. The means for controlling the magnitude of a test load can increase the top load, $F_{top}$, to reduce the upward displacement of the first pile element 2, $\Delta h_{t1}$. The top load, $F_{top}$, can allow the means for controlling the magnitude of a test load to continue increasing the magnitude of the load, $L_{T1}$, in the load test such that the upward force on the first pile element 2, $L_{T1}$, does not exceed the sum of the weight of the first pile element 2, $W_1$, and the skin friction on the first pile element 2, $F_{sh1}$, and the top load, $F_{top}$, before the applied test load, $L_{T1}$, overcomes the sum of the forces of the second pile element 3, including the skin friction, $F_{sh2}$, the weight of the second pile element 3, $W_2$, and the upward force by the underlying earth support, $F_G$.

In a preferred embodiment, the load device 33 can be located at a position along the length of the pile such that about the same magnitude of the test load, $L_{T1}$, is likely to cause rapid upward displacement of the first pile element 2 and rapid downward displacement of the second pile element 3. Specifically, where rapid displacement of the first 2 or second pile element 3 are likely to occur at magnitudes of the test load greater than $L_{T1}=(W_1+F_{sh1}+F_{top})_{fail}=(F_{sh2}+F_G-W_2)_{fail}$, where $F_{top}$ is device 33 within the pile depends on the relationship of ground resistance and shear resistance. In a typical foundation embodiment, the shear resistance, or skin friction, can be assessed according to the ground conditions, making allowance for variations in stiffness/strength and different strata, by determining the unit skin friction (or side shear per unit area) incrementally along the length of the pile, or foundation element, and adding together the contribution they make to the load bearing capacity in friction. This can then be added to the end bearing capacity to determine the ultimate load bearing capacity. The location of a single level loading device can be selected such that there is equal load bearing capacity above and below. In a specific embodiment where two levels of loading are used one load device can be above where such a single level load device location would be and the second load device below where the single level load device location would be. In a specific embodiment, the load device 33 can be placed such that about ⅓ of the pile is below the load device and about ⅔ of the pile is above the load device. If the ground beneath the bottom of the pile is not expected to provide a large enough resistance, the load device 33 can be located higher in the pile to rely more upon the shear force for load support. The optional addition of a top loading force can also allow the load device 33, within the pile, to be located closer to the top of the pile. In addition, the means for controlling the magnitude of the test load can increase the magnitude of $F_{top}$ to allow a larger test load, $L_{T1}$, to be applied.

Figure 1:
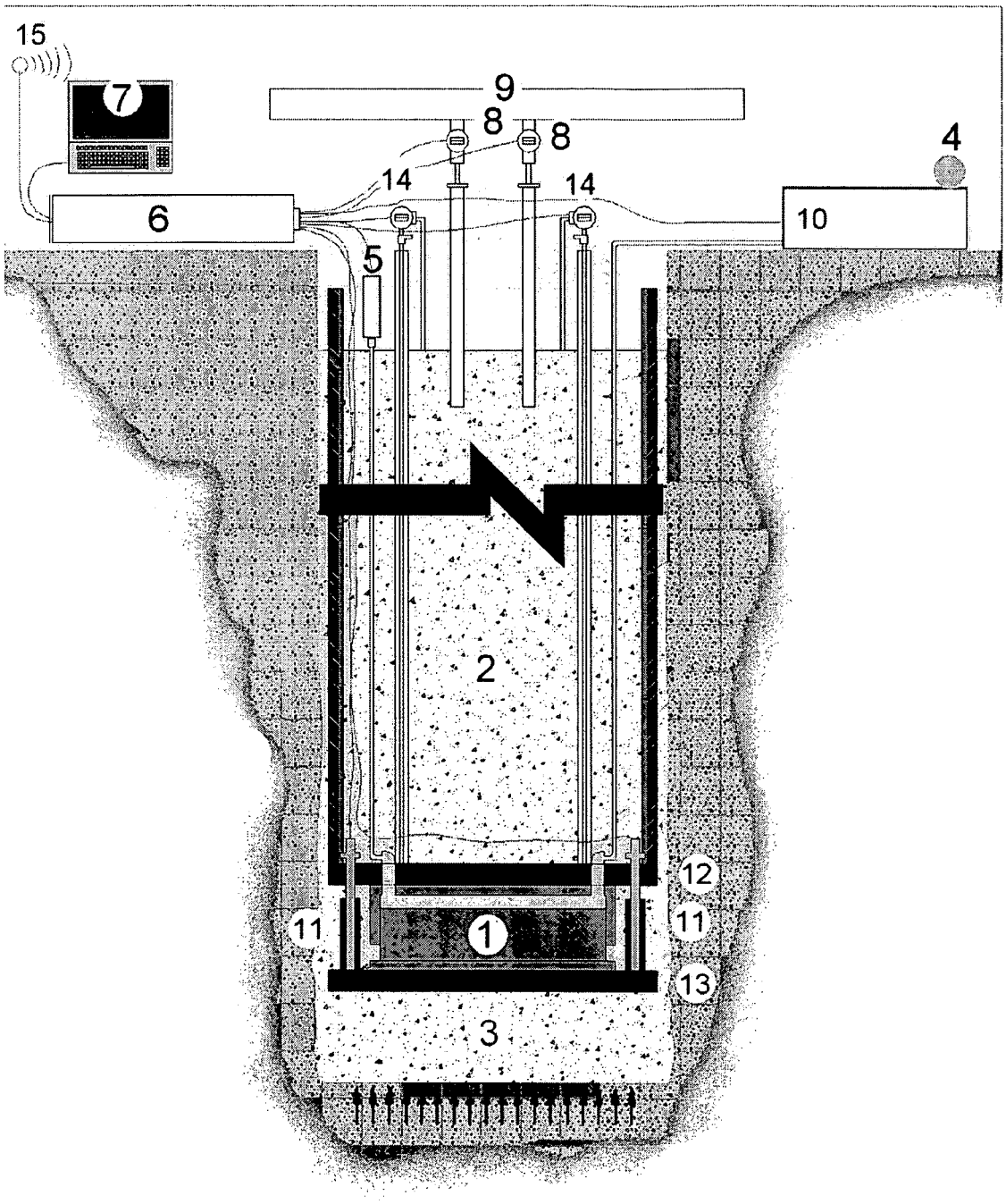
FIG. 1 shows the general configuration of a static load-testing arrangement using a single level cell.

Referring to FIG. 1, a specific embodiment of a static load test configuration is shown in accordance with the present invention. This arrangement comprises a jack 1 cast between a top, first pile element 2 and a bottom second pile element 3. A mechanical pressure indicator 4 can be mounted in the pressurized hydraulic line feeding the jack 1. An electronic pressure cell 5 can be mounted in the exhaust line of the pressurized supply to the jack 1, and connected to a data logger 6. Displacement sensors 8 can be mounted around the first pile element 2 and are used to measure the displacement of the first pile element 2 relative to a reference frame 9. Additional displacement sensors 11 can monitor the displacement of the steel plates 12 and 13 when jack 1 pushes them apart once sufficient pressure is applied. Telltale extensometer rods 14 can allow the elastic compression of the first pile element 2 to be monitored. The displacement sensors 8, 11 and 14 are also connected to the data logger 6. This data can be stored in one or more files on the data logger 6 or computer 7 for later use or review during testing.

In a specific embodiment the displacement sensors 11 monitor a hydraulic jack's ram extension. The displacement sensors 11 can be, for example, extensometers such as linear voltage displacement transducers (LVDT)'s or Linear Vibrating Wire displacement transducers (LVWDT)'s. The combined settlement rate of the first pile element 2 and the second pile element 3 can be determined from the one set of jack ram extension measurements. This embodiment is advantageous because only one set of readings need to be analyzed, while the settlement rates of both elements are simultaneously being monitored. The jack's ram extension can also be monitored by measuring the volume of hydraulic fluid pumped to the jack 1 by the hydraulic control system 10.

The downward movement of the second pile element 3 can be measured indirectly. In an embodiment, the downward movement of the second pile element 3 can be determined from the difference of the directly measured ram extension of the jack 1 and the directly measured upward movement of the upper pile element using displacement sensors 8.

In an embodiment, the ram extension of the jack can be monitored by measuring the volume of hydraulic fluid pumped to the jack 1 by the hydraulic control system 10. This can be achieved by using a volumetric flow meter (not shown), determining the level of hydraulic fluid in a reservoir of known size with a float or other means, or by any other suitable method.

In an alternate embodiment, the ram extension of the jack 1 can be measured indirectly. The ram extension of the jack 1 can be determined from the difference of the measurements from extensometers 14, provided to detect upward movement of the upper plate of jack 1, and a second extensometer rod (not shown) provided to detect downward movement of the bottom plate of jack 1. This second extensometer rod can be positioned to directly measure the downward movement of the bottom plate with respect to a reference point. For example, in a specific embodiment, the reference point can be the pile head or the top of the extensometer casing. When the ram extension of the jack 1 reaches or exceeds a predetermined value, this may be an indication of a failure or a progressive failure of one element of the pile, and a signal can be generated to halt the testing process.

In an alternate embodiment, the movement of the lower pile element can be monitored by having a telltale extensometer extending to the toe of the lower pile element. In this embodiment, as the expansion of the jack can cause a break in the casing of the extensometer, the extensometer casing can be scored to weaken the pipe at a desired point to encourage the break at that desired point.

A hydraulic control system 10, which will be described hereinafter in more detail, can serve to control the pressure to jack 1. The applied test load can be calculated by monitoring the fluid pressure in the hydraulic control system 10 driving the jack 1. This method, however, has the disadvantage that it is temperature sensitive (due to thermal expansion of the hydraulic fluid), and does not take into account friction between the jack and the point of contact with the pile in the event that the test load is being applied eccentrically. Accordingly, an alternative embodiment uses one or more electronic load cells. In a further embodiment, the electronic load cells can employ balanced strain gauges around a coaxial element. These may be placed above the jack 1 on, for example, a spherical seating arrangement so as to reduce the risk of eccentric loading.

In a further embodiment, an expansion system 24 (see FIG. 2) can be utilized to ensure that as jack 1 is operated and separates first pile element 2 and second pile element 3, undue stresses are not exerted on the hydraulic supply lines. Such a tension reducing device can be utilized for each of the hydraulic supply lines and can be arranged by, for example, encapsulating a folded pipe to exclude ingress of concrete.

In an embodiment, the measurement sensor system and the hydraulic control system 10 can be operatively linked to data logger 6, which in turn can be connected to a host personal computer (PC) 7. The data logger 6 can be connected to host computer 7 directly or by, for example, radio link or digital mobile phone serial data connection 15 to a host PC at some remote location not shown.

In an embodiment, the data logger 6 may be a "CR10", which is a data logging computer available from Campbell Scientific and often used, for example, in weather balloons. The data logger 6 can readily be programmed to regulate some, or all, of the functions. The data logger 6 can measure the displacement sensors 8, 11, and 14 at intervals of, for example, 2.5 seconds and record the data at chosen intervals. The data logger 6 can also check the load applied by the jack 1 to the first pile element 2 and second pile element 3 at each interval and can effect any change required to the applied load by, for example, controlling the hydraulic control system 10 feeding the jack 1. The data logger 6 can also be programmed to check the safe progress of the test and to control all of the load changes required.

In a specific embodiment, the measurement monitoring and control can be carried out by a suitably programmed CR10 data logger 6, which is battery-powered and can store up to 30,000 data values. The acquisition and processing functions are controlled by user-entered instructions in program form that are downloaded via a standard RS232 communications data link from a host PC 7 which acts also as a display terminal to view the actual data being monitored by the data logger 6. The host PC 7 can also receive and store the last data recorded by the data logger 6 so that it remains updated and does not require the transfer of all the data every time a connection is made. The host PC 7 can act as a display terminal while all the control and measurement functions are performed by the data logger 6 itself. In an embodiment, the data communications link can be over a modem, or digital mobile radio 15, or telephone link.

In an embodiment, the data logger 6 can have in-built functions such as a four-wire full bridge measurement facility with temperature compensation, which is employed to monitor the load applied. The standard analog input channels are used for the measurement of the displacement sensors 8 and 14. For these measurements a resolution of 333 μV on the selected full scale range of 2.5V is quoted. For an ideal displacement sensor of 100 mm travel, this equates to a resolution of 0.013 mm. A standard vibrating wire interface, not shown, can be connected to the logger to allow the linear vibrating wire displacement transducer to be measured and input into the data logger 6.

In an embodiment, two selector switches (not shown) can be connected to the digital channels allowing manual selection of the operation mode from: i) standby, ii) datum, iii) reading and iv) logging; and selection of the interval of data logging from: i) 10 seconds, ii) 1 minute, iii) 5 minutes and iv) 10 minutes. Alternatively, the control parameters within the logger can be edited by the host PC 7 or by link 15 directly.

During operation, datum values can be stored in one or more files for subsequent calculation of relative changes to the pile elements. For example, the datum values recorded at the start of the test can be subtracted from subsequent readings so that the relative changes resulting from the test can be displayed and recorded directly.

In an embodiment, a ten turn potentiometer can be provided on the front panel with a digital readout which provides for manual input to the data logger 6 of the desired load. Exact calibration of this variable resistance is not necessary because the interpreted desired load is displayed directly on the screen of the PC 7. A facility in the control software can also be included to lock off any further subsequent readings of this potentiometer, because the chosen desired load is not always as constant as might be expected. Once this facility is included in the program, the parameter location can be made directly accessible from the host PC 7 and can be changed precisely. The potentiometer can be retained as a back-up solution.

A data set can be programmed to include date and time, the readings of the displacement sensors 8, 11 and 14 and the hydraulic pressure measured together with the desired pressure to be applied.

In an embodiment, the power for the data logger 6 is derived from an uninterruptible power supply (not shown) that is arranged with a 16 A/h battery back-up, which gives a minimum of five days continuous control and logging on a fully-charged battery. Because the operation of the system can be practically continuous, portable generators (not shown) may be used to provide the main power for the host PC 7 and simultaneously to charge the battery when possible.

Advantageously, in a specific embodiment of the subject invention, the computer 7 or data logger 6 can be arranged so as to halt the testing process automatically, by for example, stopping the flow of hydraulic fluid to the jack 1, when certain conditions are detected. This automatic fail-safe procedure is a further advantage over the known methods of static load-testing, and can allow the present invention to be left unattended without undue risk. The fail-safe condition may be triggered, for example, in one or more of the following situations:

i) Where the magnitude of the applied test load reaches or exceeds a predetermined value. This may be, for example, the maximum rating of the jack 1 or the load cell.

ii) Where the magnitude of the applied test load drops by at least a predetermined amount, for example 10%, at a time when a constant load is to be maintained. This may be due to abrupt failure of either reaction system or failure of the foundation under test. Depletion of consumables such as hydraulic fluid and compressed air fail-safe intrinsically, and it therefore may not be necessary to monitor their supply.

iii) Where the magnitude of the measured displacement of either the first pile element 2 or the second pile element 3 reaches or exceeds a predetermined value, for example 10% of the pile diameter. This may be due to progressive failure of the first 2 or second 3 pile element, or excessive displacement of the first 2 or second 3 pile element due to structural failure.

iv) Where the power supply to the computer 7 or data logger 6 falls to or below a predetermined level. If this happens, the test can be discontinued and priority given to the storage of data in a passive mode. In embodiments where a 12V battery is used as a power supply, the fail-safe condition may, for example, be triggered when the potential difference across the battery drops below 10V.

v) Where communication between the load measuring means 4, 5 and/or the displacement sensors 8, 11, and 14 and the computer 7 or data logger 6 is broken. This may happen as a result of electrical connections between the data logger 6 and the displacement sensors 8, 11, and 14 or the load cells or pressure cells 5 being accidentally disconnected.

vi) In embodiments of the present invention in which two or more displacement sensors are disposed at different locations about the circumference of the pile element, where the difference between the magnitudes of the displacements measured by the two or more displacement sensors reaches or exceeds a predetermined value, for example 50% of the average value recorded. This indicates that unwanted lateral loads are being applied to the pile, which in extreme cases can lead to premature structural damage or failure. This fail-safe also helps to detect misreading from one or more of the displacement sensors.

In an embodiment, the area surrounding a pile test being undertaken in accordance with the present invention can be cordoned off with bunting, and a fine wire conductor system or trip wire may be installed so as to detect unauthorized access to the test site. Alternatively optical systems may be employed using either passive infrared detection of direct interruption of a light beam by any unauthorized access to the area. The computer can be configured so as to trigger the fail-safe condition in this event.

When the fail-safe condition is triggered, an alarm signal may be generated. This alarm signal may be transmitted to an operator or to a remote site by way of a mobile telephone or radio link, or by any other suitable method. Furthermore, data and control signals may be transmitted from and received by the computer 7 or data logger 6 so as to allow remote interrogation and control.

In a further embodiment of the subject invention, a second load device can be located between two sections of the pile, below the first load device 33, such that the pile is split into a first pile element 2 above the first load device 33, a second pile element 3 between the first and second load devices, and a third pile element 17 below the second load device. Alternatively, the second load device, or an additional load device, can be located at the bottom of a pile. In further embodiments, a third, or more, load device can be located between two sections of the pile creating a fourth, or more, pile element, respectively. The means for controlling the magnitude of a test load can communicate to the first and second load devices to apply test loads to the pile. In a specific embodiment, the first and second load devices can each incorporate two plates that can tend to separate when the load devices are activated. The application of a load by the first load device 33 can cause its upper plate to push upward against the first pile element 2 and its lower plate to push downward against the second pile element 3 and an application of a load by the second load device can cause its upper plate to push upward against the second pile element 3 and its lower plate to push downward against the third pile element 17. The means for controlling the magnitude of a test load can separately control the magnitude of the test loads applied to the first and second load devices. In addition, the means for controlling the magnitude of a test load can also monitor at least one of the following: the magnitude of the first and second test load; the expansion, $\Delta d_1$, of the first load device 33; the compression, $\Delta h_1$, of the first pile element 2; the upward displacement, $\Delta h_{t1}$, of the first pile element 2; the compression, $\Delta h_2$, of the second pile element 3; the expansion, $\Delta d_2$, of the second load device; the upward displacement, $\Delta h_{t2}$, of the second pile element 3; the downward displacement, $\Delta h_{b2}$ of the second pile element 3; the compression, $\Delta h_3$, of the third pile element 17; and downward displacement, $\Delta h_{b3}$, of the third pile element 17.

Figure 5:
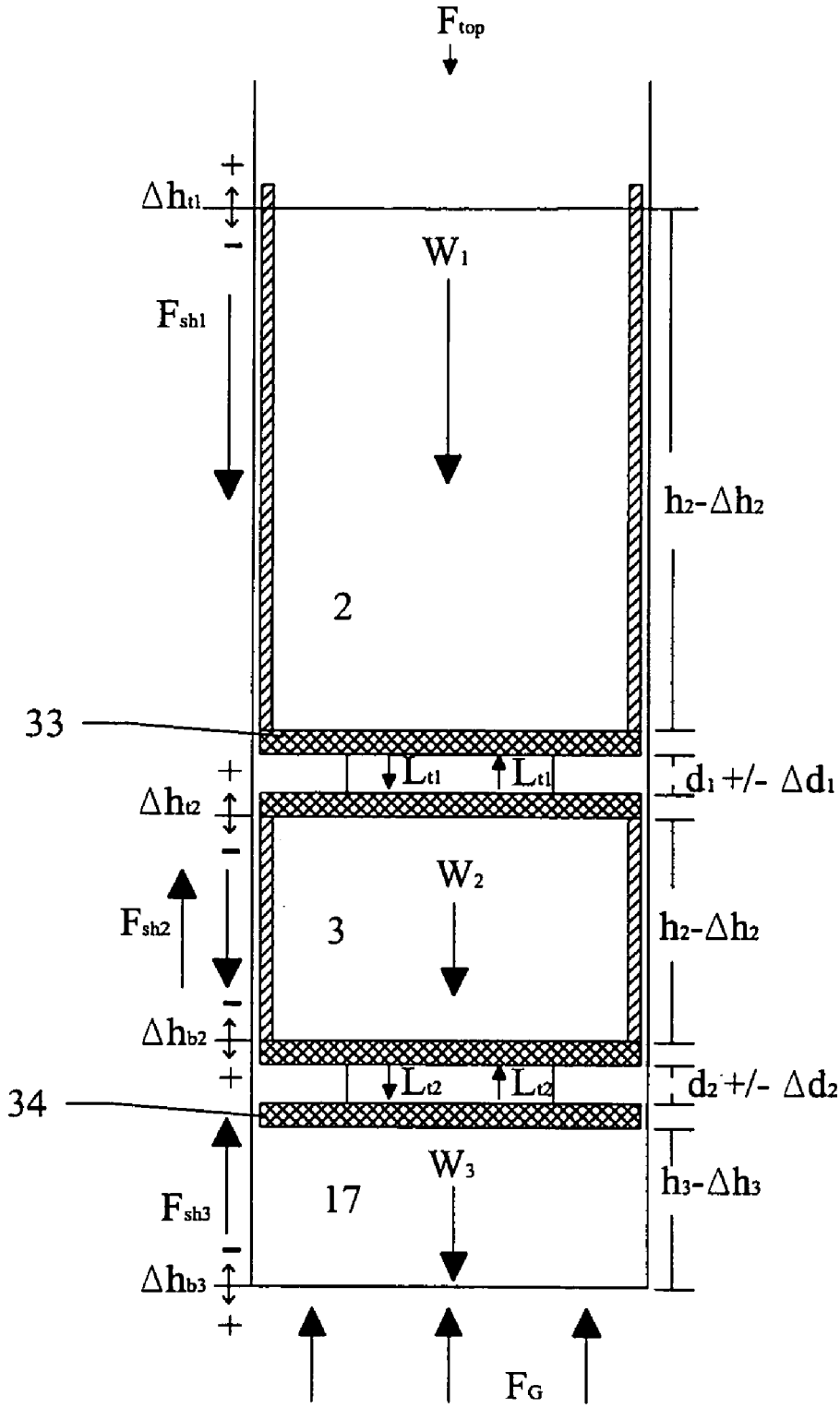
FIG. 5 shows forces on the pile elements in an embodiment of the subject invention using two load devices.

Referring to FIG. 5, the means for controlling the magnitude of a test load can apply a test load to the first and/or second load devices 33 and 34, respectively, together or individually, in accordance with a programmed testing sequence and/or in response to, for example, one or more of the following: the magnitude of the first and second test load; the expansion, $\Delta d_1$, of the first load device 33; the compression, $\Delta h_1$, of the first pile element 2; the upward displacement, $\Delta h_{t1}$, of the first pile element 2; the expansion, $\Delta d_2$, of the second load device 34; the compression, $\Delta h_2$, of the second pile element 3; the upward displacement, $\Delta h_{t2}$, of the second pile element 3; the downward displacement, $\Delta h_{b2}$ of the second pile element 3; the compression, $\Delta h_3$, of the third pile element 17; or the downward displacement, $\Delta h_{b3}$, of the third pile element 17. As the first load device 33 expands from $d_1$ to $d_1+\Delta d_1$, the upward force of the first load device 33, $L_{T1}$, is resisted by the downward weight, $W_1$, of the first pile element 2 and by the skin friction, $F_{sh1}$, caused by the force of the soil or rock surrounding the first pile element 2. A top loading force, $F_{top}$, can optionally be applied to the top of the first pile element 2 to additionally resist the upward force of the load device 33. As the second load device 34 expands from $d_2$ to $d_2+\Delta d_2$, the forces exerted on the second pile element 3 can depend on the relative forces applied by the downward force, $L_{T1}$, of the first load device 33 combined with the weight, $W_2$, of the second pile element 3, the upward force, $L_{T2}$, of the second load device 34, and the resulting shear force, $\Delta F_{sh2}$, which is shear force, $F_{sh2}$, resisting upward motion of the pile or the shear force, $F_{sh2}$, resisting downward motion of the pile caused by the force of the soil or rock surrounding the second pile element. The downward force, $L_{T2}$, of the second load device 34, combined with the weight, $W_3$, of the third pile element 17, is resisted by the skin friction, $F_{sh3}$, caused by the soil or rock surrounding the third pile element 17 and the underlying earth support, $F_G$.

In a further embodiment, the means for controlling the magnitude of a test load can maintain a constant test load over time by adjusting the supply of pressurized fluid to the expansion means of the first and second load devices 33 and 34, respectively, in response to one or more monitored measurements including, for example: the magnitude of the first and/or second test load, the expansion, $\Delta d_1$, of the first load device 33, the compression, $\Delta h_1$, of the first pile element 2, the upward displacement, $\Delta h_{t1}$, of the first pile element 2, the expansion, $\Delta d_2$, of the second load device 34, the compression, $\Delta h_2$, of the second pile element 3, the upward displacement, $\Delta h_{t2}$, of the second pile element 3, the downward displacement, $\Delta h_{b2}$ of the second pile element 3, the compression, $\Delta h_3$, of the third pile element 17, or the downward displacement, $\Delta h_{b3}$, of the third pile element 17.

In a specific embodiment, the means for controlling the magnitude of a test load can continue adjusting the loads applied to the pile until the means for controlling the magnitude of a test load detects test failure. In a specific embodiment, test failure can occur when $L_{T1}>(F_{sh1}+F_{top}+W_1)_{fail}$, where $F_{top}$ is optional, which can cause the first pile element 2 to rapidly move upward, or when $L_{T2}>(F_{sh3}+F_G-W_3)_{fail}$, which can cause the third pile element 17 to rapidly move downward. The means for controlling the magnitude of a test load can also stop the load tests when one or more fail-safe measures are triggered. Such fail-safe measures can include, but are not limited to the following: reaching a predetermined value for the magnitude of the test load, detecting a power or communications error in the means for controlling the magnitude of a test load, or detecting a breach in security at a testing location.

This embodiment is advantageous because placement of a single load device 33 within a pile can require careful calculations such that the test load applied to the pile does not cause an upward movement, due to the test load, $L_{T1}$, exceeding the sum of the weight of the first pile element 2, $W_1$, and the shear force, $F_{sh1}$, before the test indicates test failure due to the test load, $L_{T1}$, overcoming the sum of the forces of a bottom pile element, including the shear force acting on the bottom pile element, the weight of the bottom pile element, and the upward force by the underlying earth support, $F_G$. The addition of an optional top load, $F_{top}$, can also allow larger loads to be applied and can additionally resist the upward force of the first load device 33.

Figure 2:
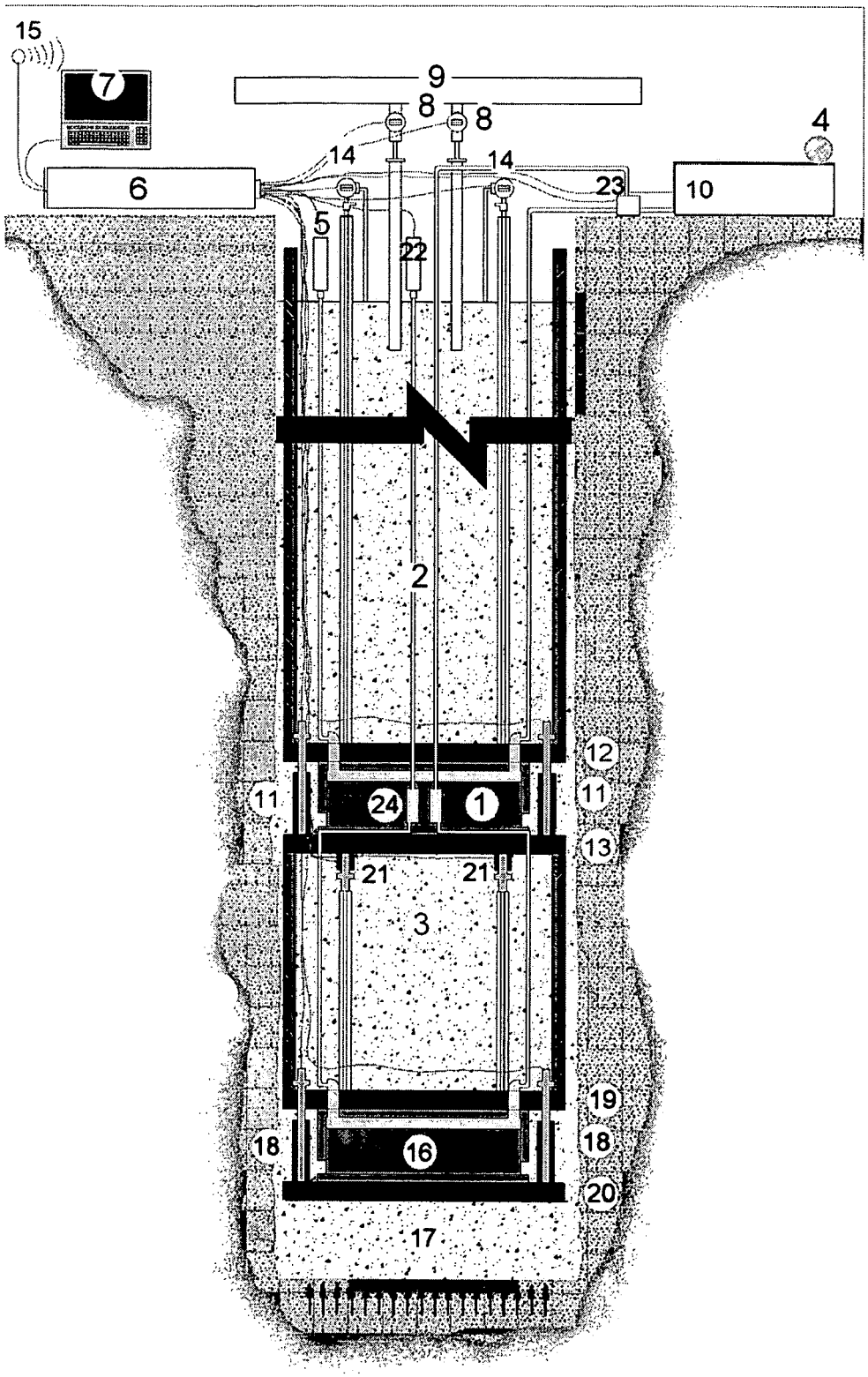
FIG. 2 shows the general configuration using a dual level cell.

In a further specific embodiment of the subject invention, as illustrated in FIG. 2, a first jack 1 is arranged to split the pile into a first pile element 2 above the jack 1 and a second pile element 3 below jack 1. This is complemented by a second jack 16, which will further split the pile as to locate the second pile element 3 above jack 16 and create a third pile element 17 below jack 16. Additional displacement sensors 18 are disposed across the steel plate 19 above jack 16 and the steel plate 20 below jack 16. An additional set of gauges 21 are arranged to measure the elastic compression of the second pile element 3. These gauges, or extensometers can be arranged to be set at the drilled shaft/pile head (not shown) or be mounted under the steel plate 13 of the upper jack 1.

Separate hydraulic supply pipes for the lower jack 16 can be brought up to the top of the drilled shaft/pile. An expansion system 24 can be utilized to ensure that as jack 1 is operated and separates first pile element 2 and second pile element 3, undue stresses are not exerted on the hydraulic supply lines. Such a tension reducing device can be utilized for each of the hydraulic supply lines and can be arranged by, for example, encapsulating a folded pipe to exclude ingress of concrete.

The control system for the lower jack 16 can include a means for providing additional pressure 22 on the return line of the hydraulic pipe and a suitable additional supply from a second pump (not shown). The second pump can be connected in parallel to pump 10 to deliver sufficient volume of hydraulic fluid in a timely manner. In an alternate embodiment the single pump 10 can be used to supply jack 16 with pressurized fluid by redirecting the pressure supply from pump 10 via a solenoid valve/switch 23.

In a specific embodiment, if the total cross-sectional area of jack 1 and jack 16 is the same, a single pump can also apply a known compression force onto second pile element 3 in order to determine the high stress elastic modulus of elasticity. This can be accomplished with a single pump 10 and a valve 23, which can feed the hydraulic pressure to both jacks simultaneously. Where jack 1 and jack 16 have different cross-sectional areas two pumps 10 can be used. The advantage of using a single electrically controlled hydraulic valve 23 and one pump 10 is that the complete testing schedule may be programmed into the data logger 6 and carried out without manual intervention with a minimum of components. If a plurality of pumps 10 is required/available, again the data logger 6 can be suitably programmed to perform the entire testing schedule. In an embodiment, the CR10 data logger 6 can be programmed to control several output ports that are conveniently arranged to operate the hydraulic control system 10.

Figure 3:
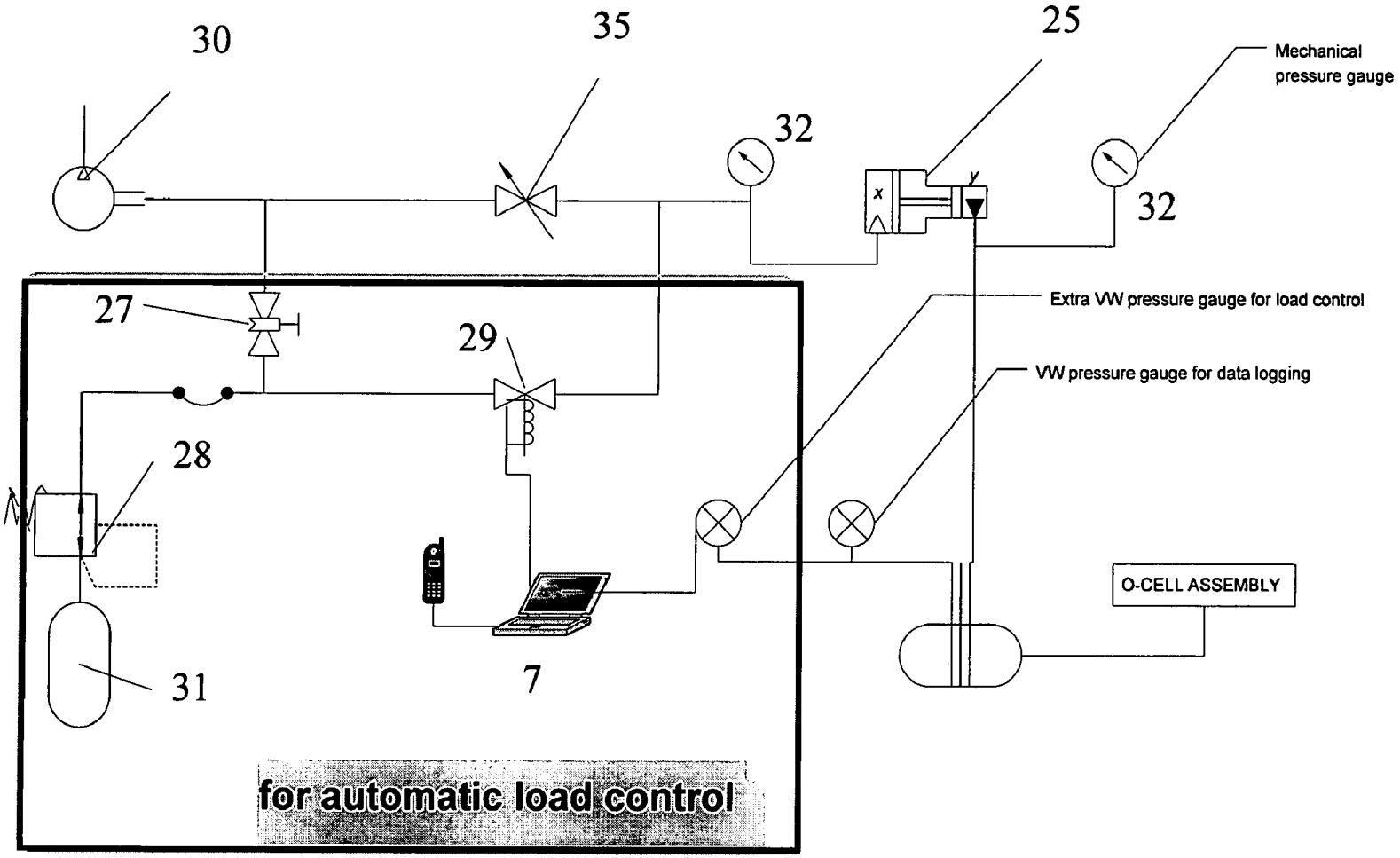
FIG. 3 shows a hydraulic control system for use with the present invention.

A specific embodiment of a hydraulic control system 10 is shown in FIG. 3. A pump 25 can increase the pressure applied to the first jack 1 and/or the second jack 16. The hydraulic pressure can be decreased manually by operating a manual control valve 35 or automatically by operating a solenoid control valve 29. In a specific embodiment, output from the data logger 6 can be used to drive, for example, MOSFETs (metal-oxide semiconductor field effect transistors) or other electronic relays that can switch the solenoid control valve 29 in the hydraulic control system 10. In an alternate embodiment a computer signal sent from a computer 7 can be used to switch the solenoid control valve 29. Alternatively, data files stored in the computer can be used to drive electronic relays that can switch the solenoid control valve.

The solenoid control valve 29 or manual control valve 35 can also control the air intake to the pump 25 and prime the pump 25 from a gas supply. In a specific embodiment, the gas supply can be a 100 psi (689 kPa) supply. A pressure regulator 28 can maintain the supply at a constant value. This gas supply can be generated from an air compressor 30. In addition, or alternatively, the gas supply can be generated from one or more gas bottles 31. In a preferred embodiment, of the one or more gas bottles can be filled with oxygen-free nitrogen. The oxygen-free nitrogen is advantageous because it is a dry gas that can minimize the condensation and subsequent freezing inside the pump 25 that can impede correct operation of the pump 25 in cold weather. In an embodiment, the rate of discharge back into the reservoir of the pump 25 can be controlled by a gate valve 27.

In a specific embodiment, pump 25 can be a Maximator RTM "S"-type air-driven hydraulic pump or a similar means, such as those made by Haskel or SC Hydraulics. The pump 25 can work on a differential area piston principle, applying air to the large surface area of an air drive piston (not shown) that is mechanically connected to a smaller hydraulic piston (not shown). This converts pneumatic energy into hydraulic power. The automatic changeover of pistons can be achieved by a pilot valve which can be triggered by a servo slide valve (not shown). Because this valve has no pressure balance control, there is no stalling during normal operation. In operation, the pump 25 can cycle more slowly as it approaches the specified maximum pressure and stop when hydraulic and air pressure forces are in balance. The pump 25 can maintain the specified pressure output without further intervention or energy consumption.

Referring again to FIG. 2, the load application to the bottom of first pile element 2 and top of second pile element 3 can be carried out by the use of a hydraulic jack 1. In a specific embodiment, a manually-operated hand pump can be used for coarse load control of the jack 1 and can be adjusted using the manual control valve 35. This aspect of the conventional test arrangement can be retained and in the event of failure of the automatic portion of the control system the test can be continued manually.

During manual load control, the load can be measured using a hydraulic pressure gauge 36, which can only be resolved to the nearest 1%, the actual resultant load control is unlikely to be better than approximately 2%. In contrast, during automatic control, employing an electronic pressure cell 5 and/or 22 and the computerized load maintaining arrangement 10, the relative magnitude of load applied can be checked every few seconds and a suitable correction can be made to the applied load if the deviation is greater than a predetermined amount, for example 5 kN. It should be noted that reliance may be placed on the resolution of the subject load measuring system to maintain the applied load constant to within 0.2% for most typical tests loads.

The magnitude of any load correction required can be determined within the data logger 6 or a computer 7. In a specific embodiment, the data logger 6 can determine the required magnitude every 2.5 seconds. This magnitude can then be translated into timing signals sent to the solenoid control valve 29 to effect an increase or a decrease of the hydraulic pressure. In addition, a scaling factor can be employed to make the system sufficiently versatile to accommodate varying sizes of jack 1 and or jack 16 and perform successfully the two principal functions of maintaining the load within tight boundaries and changing the load when required.

A simple control algorithm can be employed to determine the duration of a control pulse that can open the solenoid control valve 29 for a predetermined period corresponding to the load change required. The timing interval can be derived from an equation of the form $t_p = C0 + C2x^2$, where $t_p$ is the duration of the control pulse, C0 is the minimum pulse width, C2 is the gain of the control loop, and x is the difference between applied load and desired load. The minimum pulse width, C0, represents the smallest time interval before the mechanical solenoids operate, as there is a finite time for electrically operated mechanical systems incorporating, for example, solenoids to operate once activated. For most typical jack 1 and/or jack 16 in the 3 MN to 10MN range, the optimum C2 value is 22, and C0 remains constant at 1.5.

When changing loads, the operation of the timing circuits is preferably limited to a maximum of approximately 1.5 seconds. It is usually less than the 2.5 seconds program cycle to ensure correct operation of the software. The loads can be stepped up or down sequentially in adjustable steps of typically 20 kN per cycle of 2.5 seconds in a very controlled manner.

A significant advantage of a computerized hydraulic control system 10 is that the load applied can be held truly constant within tight controllable limits. As a consequence, the displacement in time of the foundation system under test is not distorted by induced load variations and consequential changes to the elastic shortening.

Many suitable electronic displacement sensors 8, 11, 14, 18 and 21 are commercially available, allowing total displacements of up to 250 mm to be measured with excellent resolution. The currently preferred and most reliable sensors 8 and 14 are resistive elements which employ a carbon strip such as those from Penny & Giles (typical ref: HLP190/FS1/100/4k) and for the embedded displacement sensors 11, 18 and 21 Geocon LVWDT type 4450-3 series.

A modification that can be implemented on some of the sensors is the installation of a return spring (not shown) to ensure that the travel of the arm of the sensor is sprung loaded to its fully-extended position. Penny & Giles offer a sprung-loaded sensor. With respect to sensor 8 and 14, a suitable mounting arrangement that allows the gauges to be secured and rapidly attached to the reference frame 9 or extensometer outer tubing can be installed. Sensors 11, 18, and 21 can also utilize suitable mounting arrangements.

Calibration of the displacement sensors 8, 11, 14, 18 and 21 is also desirable to ensure that constancy between different sensors 8 is maintained. This calibration may be carried out against a digital vernier caliper or calibrated spacer blocks. It should be noted that one of the largest inaccuracies typically encountered during calibration is the verticality of the gauge with respect to the reference standard. This only becomes significant when high accuracy is being sought as repeatability of measurement with just a 0.1° variation, which represents less than 1:1000. This can be equated to a variation of displacement of 0.1%. This inaccuracy with verticality of the gauge is also applicable to measurement of pile head movement.

All patents, patent applications, provisional applications, and publications referred to or cited herein are incorporated by reference in their entirety, including all figures and tables, to the extent they are not inconsistent with the explicit teachings of this specification.

It should be understood that the examples and embodiments described herein are for illustrative purposes only and that various modifications or changes in light thereof will be suggested to persons skilled in the art and are to be included within the spirit and purview of this application.

We claim:

1. An apparatus for testing the static load-bearing capacity of a pile comprising:

a means for applying a test load disposed within a pile such that the pile is split into a first pile element and a second pile element, wherein the first pile element is above the means for applying a test load and the second pile element is below the means for applying a test load;

a means for determining the magnitude of the test load;

a means for determining the upward displacement of the first pile element;

a means for determining the downward displacement of the second pile element;

a means for controlling the magnitude of a test load; and a means for determining the combined settlement rate of the first pile element and the second pile element, wherein the means for controlling the magnitude of the test load monitors the magnitude of the test load and the combined settlement rate of the first pile element and the second pile element and controls the magnitude of the test load in response to the magnitude of the test load and the combined settlement rate of the first pile element and the second pile element.

2. The apparatus according to claim 1, wherein the means for determining the combined settlement rate of the first pile element and the second pile element comprises:

a means for determining the change in separation between the first pile element and the second pile element.

3. The apparatus according to claim 2, wherein the means for applying a test load comprises:

an upper plate;

a lower plate, wherein the lower plate is parallel to the upper plate and spaced apart from the upper plate; and an expansion means, wherein die expansion means is positioned between the upper plate and the lower plate, wherein the expansion means tends to separate the upper plate and the lower plate in response to the supply of pressurized fluid to the expansion means.

4. The apparatus according to claim 3, wherein the means for determining the change in separation between the first pile element and the second pile element comprises:

a means for measuring the change in the separation between the upper plate and the lower plate, wherein the means for measuring the change in the separation between the upper plate and the lower plate comprises one or more extensometers.

5. The apparatus according to claim 4, wherein the extensometers comprise linear voltage displacement transducers.

6. The apparatus according to claim 4, wherein the extensometers comprise vibrating wire displacement transducers.

7. The apparatus according to claim 3, wherein the means for determining a change in separation between the first pile element and the second pile element comprises a means for measuring a volume of fluid supplied to the expansion means.

8. An apparatus for testing the static load-bearing capacity of a pile comprising:

a means for applying a test load disposed within a pile such that the pile is split into a first pile element and a second pile element, wherein the first pile element is above the means for applying a test load and the second pile element is below the means for applying a test load;

a means for determining the magnitude of the test load;

a means for determining the upward displacement of the first pile element;

a means for determining the downward displacement of the second pile element; and a means for controlling the magnitude of a test load, wherein the means for controlling the magnitude of a test load monitors the magnitude of the test load, the upward displacement of the first pile element, and the downward displacement of the second pile element, wherein the means for controlling the magnitude of a test load controls the magnitude of the test load in response to the magnitude of the test load, the rate of upward displacement of the first pile element and the rate of downward displacement of the second pile element.

9. An apparatus for testing the static load-bearing capacity of a pile comprising:

a means for applying a test load disposed within a pile such that the pile is split into a first pile element and a second pile element, wherein the first pile element is above the means for applying a test load and the second pile element is below the means for applying a test load;

a means for determining the magnitude of the test load;

a means for determining the upward displacement of the first pile element;

a means for determining the downward displacement of the second pile element; and a means for controlling the magnitude of a test load, wherein the means for controlling the magnitude of a test load monitors the magnitude of the test load, the upward displacement of the first pile element, and the downward displacement of the second pile element, wherein the means for controlling the magnitude of a test load controls the magnitude of the test load in response to the magnitude of the test load, the upward displacement of the first pile element, and the downward displacement of the second pile element.

10. The apparatus according to claim 8, wherein the means for applying a test load is disposed within the pile such that the pile is split in a plane normal to the axis of the pile.

11. The apparatus according to claim 8, further comprising a means for determining the change in separation between the first pile element and the second pile element, wherein the change in separation between the first pile element and the second pile element is the summation of the upward displacement of the first pile element and the downward displacement of the second pile element.

12. The apparatus according to claim 8, wherein the means for determining the upward displacement of the first pile element comprises a means for measuring the upward displacement of the first pile element.

13. The apparatus according to claim 12, wherein the means for measuring the upward displacement of the first pile element comprises at least one displacement sensor.

14. The apparatus according to claim 12, wherein the means for determining the downward displacement of the second pile element comprises:

the means for measuring the upward displacement of the first pile element; and a means for measuring the change in separation between the first pile element and the second pile element, wherein the downward displacement of the second pile element is the change in separation between the first pile element and the second pile element minus the upward displacement of the first pile element.

15. The apparatus according to claim 8, wherein the means for determining the downward displacement of the second pile element comprises a means for measuring the downward displacement of the second pile element.

16. The apparatus according to claim 8, further comprising a means for measuring the compression of the first pile element.

17. The apparatus according to claim 16, wherein the means for measuring the compression of the first pile element comprises one or more extensometers, wherein the extensometers are located within the first pile element and span the distance between the means for applying a test load and the top of the first pile element.

18. The apparatus according to claim 17, further comprising a means for measuring the compression of the second pile element.

19. The apparatus according to claim 8, wherein the means for applying a test load comprises:

an upper plate;

a lower plate, wherein the lower plate is parallel to the upper plate and spaced apart from the upper plate; and an expansion means , wherein the expansion means is positioned between the upper plate and the lower plate, wherein the expansion means tends to separate the upper plate and the lower plate in response to the supply of pressurized fluid to the expansion means;

a pressurized fluid line connected to the expansion means, wherein the pressurized fluid line transmits a pressurized fluid to the expansion means; and a pressurized fluid supply, wherein the pressurized fluid supply supplies the expansion means with the pressurized fluid through the pressurized fluid line.

20. The apparatus according to claim 19, further comprising a pressurized fluid exhaust line connected to the expansion means, wherein the pressurized fluid exhaust line selectively removes the pressurized fluid from the expansion means.

21. The apparatus according to claim 19, wherein the means for controlling the magnitude of a test load comprises a means for adjusting the pressure of the fluid of the pressurized fluid supply, wherein adjusting the pressure of the fluid of the pressurized fluid supply adjusts the magnitude of the test load.

22. The apparatus according to claim 21, wherein the means for adjusting the pressure of the fluid of the pressurized fluid supply allows manual adjustment of the pressure of the fluid of the pressurized fluid supply.

23. An apparatus according to claim 21, wherein the pressurized fluid is hydraulic fluid, wherein the means for adjusting the pressure of the fluid of the pressurized fluid supply comprises:

a pneumatic to hydraulic pump, wherein the pneumatic to hydraulic pump controls the pressure of the fluid of the pressurized fluid supply;

a pressurized gas supply; and a means for controlling the intake of pressurized gas from the pressurized gas supply into the pneumatic to hydraulic pump, wherein controlling the intake of pressurized gas from the pressurized gas supply into the pneumatic to hydraulic pump controls the pressure of the fluid of the pressurized fluid supply.

24. An apparatus according to claim 23, wherein the means for controlling the intake of pressurized gas from the pressurized gas supply into the pneumatic to hydraulic pump comprises a solenoid control valve.

25. An apparatus according to claim 19, wherein the means for measuring the magnitude of a test load comprises an electronic pressure cell, wherein the electronic pressure cell is located in the pressurized fluid exhaust line to measure fluid pressure in the fluid exhaust line and communicates the fluid pressure in the fluid exhaust line to the means for controlling the magnitude of a test load, wherein the means for controlling the magnitude of a test load determines the magnitude of the test load from the fluid pressure.

26. An apparatus according to claim 19, wherein the means for measuring the magnitude of the test load comprises one or more electronic load cells, wherein the one or more electronic load cells measure the test load and communicate the magnitude of the test load to the means for controlling the magnitude of a test load.

27. An apparatus according to claim 8, wherein the means for applying a test load comprises at least one hydraulic jack.

28. An apparatus according to claim 8, wherein the means for controlling the magnitude of a test load detects a fail-safe trigger and then communicates to the means for applying a test load to stop applying the test load such that the measuring of the load-bearing capacity of a pile automatically stops.

29. The apparatus according to claim 28, wherein the fail-safe triggers comprise at least one of the following:

a) an event wherein the magnitude of the test load reaches or exceeds a predetermined value;

b) an event wherein the magnitude of the test load drops by a predetermined value;

c) an event wherein the communication fails between the means for controlling the magnitude of a test load and the means for measuring the magnitude of the test load;

d) an event wherein the magnitude of the test load reaches or exceeds the maximum rating of a jack or load cell;

e) an event wherein the magnitude of the test load drops by 10% at a time when a constant load is to be maintained;

f) an event wherein the difference between the magnitudes of the displacements measured by two or more displacement sensors located at different locations about the circumference of a horizontal plane of the pile reaches or exceeds a predetermined value;

g) an event wherein the magnitude of change in displacement between the first pile element and the second pile element reaches or exceeds a predetermined value;

h) an event wherein the communication fails between the means for controlling the magnitude of a test load and a means for measuring the change in displacement between the first pile element and the second pile element;

i) an event wherein the magnitude of upward displacement reaches or exceeds a predetermined value;

j) an event wherein the communication fails between the means for controlling the magnitude of a test load and a means for measuring the upward displacement of the first pile element;

k) an event wherein the magnitude of measured displacement of the first pile element reaches 10% of the pile diameter;

l) an event wherein the magnitude of downward displacement reaches or exceeds a predetermined value;

m) an event wherein the communication fails between the means for controlling the magnitude of a test load and a means for measuring downward displacement of the second pile element;

n) an event wherein the magnitude of measured displacement of the second pile element reaches 10% of the pile diameter;

o) an event wherein the communication fails between the means for controlling the magnitude of a test load and a means for measuring compression of the first pile element; and p) an event wherein the communication fails between the means for controlling the magnitude of a test load and a means for measuring compression of the second pile element.

30. An apparatus according to claim 8, wherein the means for applying a test load applies an upward load, $L_T$, to the bottom of the first pile element and a downward load, $L_T$, to the top of the second pile element, wherein the means for applying a test load is disposed within the pile such that approximately the same magnitude of the test load, $L_T$, causes test failure from upward displacement of the first pile element and causes test failure from downward displacement of the second pile element, wherein a test failure occurs at magnitudes of the test load that cause a rapid movement of the first pile element and the second pile element.

31. An apparatus according to claim 8, wherein the means for applying a test load applies an upward load, $L_T$, to the bottom of the first pile element and a downward load, $L_T$, to the top of the second pile element, wherein the means for applying a test load is disposed within the pile such that the upward load capacity of the first pile element, $F_{sh1}+W_1$, is approximately equal to the downward load capacity of the second pile element, $F_{sh2}+F_G-W_2$, where $F_{sh1}$ is the shear force on the side of the first pile element, $W_1$ is the weight of the first pile element, $F_{sh2}$ is the shear force on the side of the second pile element, $F_G$, is the upward force the underlying earth support exerts on the bottom of the second pile element, and $W_2$ is the weight of the second pile element.

32. The apparatus according to claim 8, further comprising a means for applying a test load to the top of the first pile element.

33. An apparatus according to claim 8, further comprising:

a means for applying a second test load disposed between the bottom of the second pile element and the bottom of a hole in which the pile is located, wherein the second pile element is above the means for applying a second test load; and a means for determining the magnitude of a second test load;

a means for determining change in separation between the bottom of the second pile element and the bottom of the hole, wherein the means for controlling the magnitude of the test load monitors the magnitude of the second test load and the change in separation between the bottom of the second pile element and the bottom of the hole, wherein the means for controlling the magnitude of the test load controls the magnitude of the second test load.

34. An apparatus according to claim 33, wherein the means for applying a second test load comprises:

a second upper plate;

a second lower plate, wherein the second lower plate is parallel to the second upper plate and spaced apart from the second upper plate, a second expansion means, wherein the second expansion means is positioned between the second upper plate and the second lower plate, wherein the second expansion means tends to separate the second upper plate and the second lower plate in response to the supply of pressurized fluid to the second expansion means, wherein the means for determining the change in separation between the bottom of the second pile element and the bottom of the hole comprises a means for measuring the separation between the second upper plate and the second lower plate.

35. An apparatus according to claim 34, wherein the means for applying a second test load further comprises:

a second pressurized fluid line connected to the second expansion means, wherein the second pressurized fluid line transmits the pressurized fluid to the second expansion means; and a second pressurized fluid supply, wherein the second pressurized fluid supply supplies the second expansion means with the pressurized fluid through the second pressurized fluid line.

36. An apparatus according to claim 34, wherein the pressurized fluid supply is connected to the corresponding pressurized fluid lines by a solenoid valve or switch.

37. An apparatus according to claim 34, further comprising a second pressurized fluid supply, wherein the second pressurized fluid supply supplies the second expansion means with the pressurized fluid through the second pressurized fluid line.

38. An apparatus according to claim 8, further comprising:

a means for applying a second test load disposed within the pile such that the pile is split into three pile elements wherein the second pile element is above the means for applying a second test load and a third pile element is below the means for applying a second test load; and a second means for determining the magnitude of a second test load; and a second means for determining change in separation between the second pile element and the third pile element, wherein the means for controlling the magnitude of the test load monitors the magnitude of the second test load and the change in separation between the second pile element and the third pile element, wherein the means for controlling the magnitude of the test load controls the magnitude of the second test load.

39. The apparatus according to claim 38, wherein the means for applying a second test load is disposed within the pile such that the pile is split in a plane normal to the axis of the pile.

40. The apparatus according to claim 38, further comprising a means for measuring compression of the third pile element.

41. The apparatus according to claim 38, wherein the means for applying a second test load comprises:

a second upper plate;

a second lower plate, wherein the second lower plate is parallel to the second upper plate and spaced apart from the second upper plate;

a second expansion means, wherein the second expansion means is positioned between the second upper plate and the second lower plate, wherein the second expansion means tends to separate the second upper plate and the second lower plate in response to the supply of pressurized fluid to the second expansion means;

a second pressurized fluid line, and a second pressurized fluid exhaust line, wherein the second pressurized fluid line connects the pressurized fluid supply to the second expansion means.

42. An apparatus according to claim 41, further comprising a second pressurized fluid supply, wherein the corresponding pressurized fluid line connects the second pressurized fluid supply to the corresponding expansion means.

43. An apparatus according to claims 41, wherein the pressurized fluid supply is connected to the corresponding pressurized fluid lines by a solenoid valve or switch.

44. The apparatus according to claim 38, further comprising a means for applying a test load to the top of the first pile element.

45. An apparatus according to claim 38, wherein the means for applying a test load and the means for applying a second test load comprise hydraulic jacks.

46. The apparatus according to claim 45, wherein the hydraulic jacks have different cross sectional areas.

47. An apparatus according to claim 38, wherein an additional means for applying a test load is disposed between the bottom of the pile and the bottom of a hole in which the pile is located.

48. An apparatus according to claim 38, further comprising:

a one or more additional means for applying a test load disposed within a pile such that the pile is split into three or more pile elements, wherein the third pile element, below the means for applying a second test load, is above the one or more additional means for applying a test load, and the one or more additional means for applying a test load has a corresponding pile element below the one or more additional means for applying a test load; and a corresponding additional means for determining the magnitude of the test load;

a corresponding additional means for determining the change in separation between the pile element above the one or mare additional means for applying a test load and the pile element below the one or more additional means for applying a test load.

49. The apparatus according to claim 48, wherein the one or more additional means for applying a test load is disposed within the pile such that the pile is split in a plane normal to the axis of the pile.

50. The apparatus according to claim 48, further comprising a corresponding means for measuring compression of the additional pile elements.

51. An apparatus according to claim 48, wherein the means for applying a test load, the means for applying a second test load, and the one or more additional means for applying a test load comprise hydraulic jacks.

52. An apparatus according to claim 51, wherein the jacks have different cross-sectional areas.

53. An apparatus according to claim 48, wherein the one or more additional means for applying a test load comprises:

a corresponding additional upper plate;

a corresponding additional lower plate, wherein the corresponding additional lower plate is parallel to the corresponding additional upper plate and spaced apart from the corresponding additional upper plate;

a corresponding additional expansion means, wherein the corresponding additional expansion means is positioned between the corresponding additional upper plate and the corresponding additional lower plate, wherein the corresponding additional expansion means tends to separate the corresponding additional upper plate and the corresponding additional lower plate in response to the supply of pressurized fluid to the corresponding additional expansion means;

a corresponding additional pressurized fluid line, and a corresponding additional pressurized fluid exhaust line, wherein the corresponding additional pressurized fluid line connects the pressurized fluid supply to the corresponding additional expansion means.

54. An apparatus according to claim 53, further comprising a third or more pressurized fluid supply, wherein the corresponding additional pressurized fluid line connects the third or more pressurized fluid supply to the corresponding additional expansion means.

55. An apparatus according to claim 53, wherein the pressurized fluid supply is connected to the corresponding pressurized fluid lines by a solenoid valve or switch.

* * * * *

UNITED STATES PATENT AND TRADEMARK OFFICE

CERTIFICATE OF CORRECTION

PATENT NO. : 7,353,714 B2
APPLICATION NO. : 11/192765
DATED : April 8, 2008
INVENTOR(S) : England et al.

It is certified that error appears in the above-identified patent and that said Letters Patent is hereby corrected as shown below:

Column 10,
Line 24, "where $F_{top}$ is device 33 within the pile" should read
--where $F_{top}$ is optional. The location of the load device 33 within the pile--.

Column 19,
Line 55, "wherein die expansion means" should read --wherein the expansion means--.

Signed and Sealed this

Thirtieth Day of September, 2008

JON W. DUDAS
*Director of the United States Patent and Trademark Office*